US011614258B2

(12) United States Patent
Choi

(10) Patent No.: US 11,614,258 B2
(45) Date of Patent: Mar. 28, 2023

(54) BOILER AND THE METHOD FOR CONTROLLING COMBUSTION OF THE BOILER

(71) Applicant: KYUNGDONG NAVIEN CO., LTD., Pyeongtaek-si (KR)

(72) Inventor: Hyuk Choi, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 364 days.

(21) Appl. No.: 16/709,395

(22) Filed: Dec. 10, 2019

(65) Prior Publication Data

US 2020/0208877 A1 Jul. 2, 2020

(30) Foreign Application Priority Data

Dec. 28, 2018 (KR) ..... 10-2018-0171447

(51) Int. Cl.
*F24H 9/20* (2022.01)
*F23N 1/02* (2006.01)

(52) U.S. Cl.
CPC ..... *F24H 9/2035* (2013.01); *F23N 1/022* (2013.01); *F23N 2225/04* (2020.01); *F23N 2231/28* (2020.01); *F23N 2233/08* (2020.01); *F23N 2239/04* (2020.01); *F23N 2241/04* (2020.01)

(58) Field of Classification Search
CPC .. F23N 1/022; F23N 2225/04; F23N 2233/08; F23N 2241/04; F23N 2241/06; F24H 9/2035; F24H 9/2042
See application file for complete search history.

(56) References Cited

U.S. PATENT DOCUMENTS

2009/0099667 A1* 4/2009 Sekiai ..... G05B 13/048 700/297
2017/0038068 A1* 2/2017 Yang ..... F23N 5/245

FOREIGN PATENT DOCUMENTS

JP 2003286834 A * 10/2003
JP 2016057044 A * 4/2016 ..... F23C 7/008
KR 10-0153711 B1 2/1999
KR 100704715 B1 * 4/2007 ..... F24H 9/0026
KR 20110032751 A * 9/2009
KR 10-1815987 B1 2/2018

* cited by examiner

*Primary Examiner* — Edelmira Bosques
*Assistant Examiner* — Michael James Giordano
(74) *Attorney, Agent, or Firm* — Stein IP, LLC

(57) ABSTRACT

The present invention relates to a boiler which determines a clogging degree of an exhaust flue through which combustion gas is discharged and adjusts gas supply amount to maintain its combustibility, and a combustion control method thereof, the method of the present invention including a) setting a target heat value for achieving a target temperature, b) applying a first database on the basis of the target heat value, c) measuring a rotational speed of an air blower and a pneumatic pressure of air introduced by rotation of the air blow, d) applying a second database on the basis of a rotational speed difference, a pneumatic pressure difference, and the target heat value to calculate an estimated flue clogging value according to the target heat value, and a) applying a third database according to the estimated flue clogging value to calculate an opening amount of a gas valve and control gas supply amount.

9 Claims, 5 Drawing Sheets

[FIG. 1]
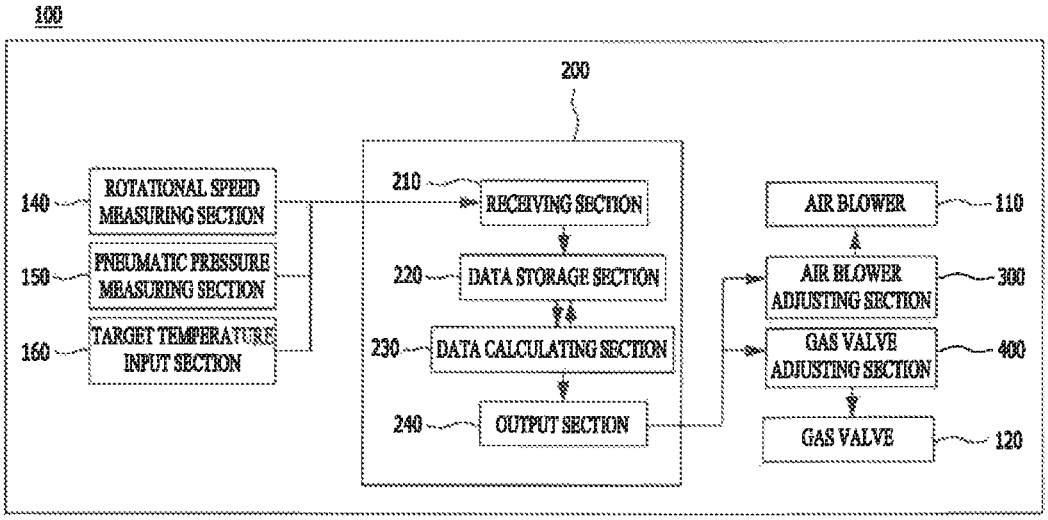

[FIG. 2]
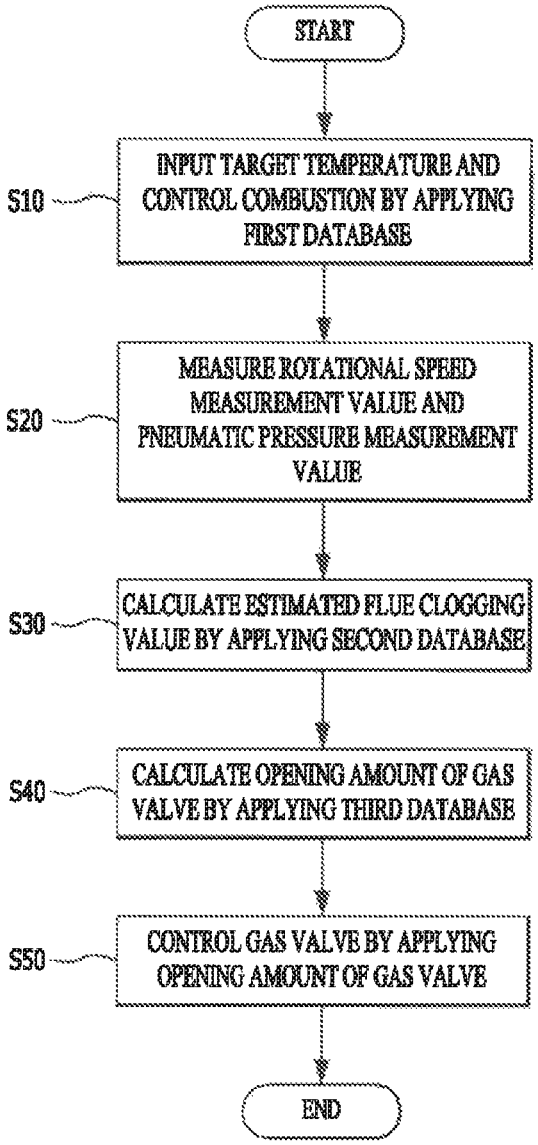

[FIG. 3]

T=100

| P \ V(RPM) | 47 | 169 | 321 | 583 | 895 | 1494 |
|---|---|---|---|---|---|---|
| 0 | 0 | 50 | 60 | 70 | 80 | 80 |
| 15 | 80 | 80 | 80 | 80 | 80 | 80 |
| 36 | 90 | 90 | 90 | 90 | 90 | 90 |

[FIG. 4]

T=80

| P \ V(RPM) | 117 | 251 | 336 | 600 | 1120 | 1174 |
|---|---|---|---|---|---|---|
| 0 | 0 | 50 | 60 | 70 | 80 | 90 |
| 18 | 90 | 90 | 90 | 90 | 90 | 90 |

[FIG. 5]

T=100

| P \ V(RPM) | 47 | 169 | 321 | 583 | 624 | 895 | 1494 |
|---|---|---|---|---|---|---|---|
| 0 | 0 | 50 | 60 | 70 | | 80 | 80 |
| 15 | 80 | 80 | 80 | 80 | | 80 | 80 |
| 16 | | | | B1 | B2 | B3 | |
| 36 | 90 | 90 | 90 | 90 | | 90 | 90 |

[FIG. 6]

T=80

| P \ V(RPM) | 117 | 251 | 336 | 600 | 624 | 1120 | 1174 |
|---|---|---|---|---|---|---|---|
| 0 | 0 | 50 | 60 | 70 | | 80 | 90 |
| 16 | | | | B4 | B5 | B6 | |
| 18 | 90 | 90 | 90 | 90 | | 90 | 90 |

[FIG. 7]

| TARGET HEAT VALUE | ESTIMATED FLUE CLOGGING VALUE |
|---|---|
| 80% | B5 |
| 90% | B |
| 100% | B2 |

[FIG. 8]

| ESTIMATED FLUE CLOGGING VALUE | OPENING AMOUNT OF GAS VALVE |
|---|---|
| 0% | 0 |
| 50% | 0 |
| 60% | 0 |
| 70% | 3 |
| 80% | 7 |
| 90% | 9 |

[FIG. 9]

| ESTIMATED FLUE CLOGGING VALUE | OPENING AMOUNT OF GAS VALVE |
|---|---|
| 0% | 0 |
| 50% | 0 |
| 60% | 0 |
| 70% | 3 |
| 80% | 7 |
| 8% | X |
| 90% | 9 |

BOILER AND THE METHOD FOR CONTROLLING COMBUSTION OF THE BOILER

CROSS-REFERENCE TO RELATED APPLICATION

This application claims priority to and the benefit of Korean Patent Application No. 10-2018-0171447, filed on Dec. 28, 2018, the disclosure of which is incorporated herein by reference in its entirety.

BACKGROUND

1. Field of the Invention

The present invention relates to a boiler and a combustion control method of a boiler, and more particularly, a boiler which may determine a clogging degree of an exhaust flue through which combustion gas is discharged and adjust a gas supply amount to maintain combustibility in the boiler, and a combustion control method thereof.

2. Discussion of Related Art

In gas boilers using heat generated by combustion of gas as a means for being provided with heating or hot water, an exhaust flue, which is a passage through which burned combustion gas flows and is discharged to the outside, is generally provided.

In this case, the inside of the exhaust flue is corroded by carbon or nitrogen contained in the combustion gas or a mixture is accumulated in the exhaust flue and an internal diameter of the exhaust flue may be reduced, and an exhaust flue clogging phenomenon may occur often due to environmental factors such as deformation or damage caused by an external force, inflow of backwind through an exhaust port, or the like.

When the exhaust flue clogging phenomenon occurs, the combustion gas is not discharged smoothly, and thus a pressure inside the combustion chamber is increased and a gas supply amount is reduced to lower the efficiency of the boiler, and a misfire occurs. As a result, there has been a problem that combustibility in the boiler is lowered.

Accordingly, a method of sensing a clogging degree of an exhaust flue and adjusting an amount of gas supplied to a boiler according to the clogging degree to maintain combustibility has been studied.

Disclosure in Korean Patent Registration No. 10-1815987 is one example of the related art for sensing the clogging phenomenon of the exhaust flue as described above.

SUMMARY OF THE INVENTION

The present invention has been devised to solve the above-mentioned problems, and an object of the present invention is to provide a boiler which may determine a clogging degree of an exhaust flue through which combustion gas is exhausted in real time to adjust a gas supply amount and to maintain combustibility thereof, and a combustion control method thereof.

In order to solve the above problems, a combustion control method according to one aspect of the present invention is a combustion control method of a boiler including an air blower configured to rotate such that air and gas are introduced, a gas valve configured to adjust an opening or closing degree of a gas supply pipe into which gas is introduced, and a controller configured to control the air blower and the gas valve, the method may include the steps of A) measuring a change in rotational speed of the air blower according to a target heat value and a change in pneumatic pressure which is a pressure of air introduced by rotation of the air blower to calculate an estimated flue clogging value and B) controlling an opening amount of the gas valve according to the estimated flue clogging value to control a supply amount of gas which is being introduced.

The step A) may include the steps of a) inputting a target temperature of heat or hot water provided by operation of the boiler and setting a target heat value for achieving the target temperature, b) calculating a target rotational speed of the air blower, a target pneumatic pressure which is the pressure of the air introduced by rotation of the air blower, and target opening amount of the gas valve according to the target heat value and applying the target rotational speed, the target pneumatic pressure, and the target opening amount to control of the air blower and the gas valve, c) measuring the rotational speed of the air blower and the pneumatic pressure of the air introduced by rotation of the air blower in real time, and d) calculating a rotational speed difference which is a difference between the target rotational speed and a rotational speed measurement value, calculating a pneumatic pressure difference which is a difference between the target pneumatic pressure and a pneumatic pressure measurement value, and calculating the estimated flue clogging value according to the target heat value, the rotational speed difference, and the pneumatic pressure difference.

In the step b), the controller may be configured to calculate the target rotational speed and the target pneumatic pressure according to the target heat value by substituting the target heat value into a first database in which data of the target rotational speed, the target pneumatic pressure, and the opening amount of the gas valve are stored.

In the step d), the controller may be configured to calculate the opening amount of the gas valve according to the estimated flue clogging value by substituting the estimated flue clogging value into a third database in which data of the opening amount of the gas valve is stored.

The estimated flue clogging value and the opening amount of the gas valve may be linearly calculated and output using interpolation in which at least two pieces of data which are preset or calculated in advance are represented as a linear equation.

A boiler according to another aspect of the present invention may include a rotational speed measuring section configured to measure a rotational speed of an air blower by which gas and air are introduced, a pneumatic pressure measuring section configured to measure a pneumatic pressure which is a pressure of air introduced through the air blower, and a controller configured to measure a change in rotational speed of the air blower and a change in pneumatic pressure according to a target heat value to calculate an estimated flue clogging value and to adjust an opening amount of a gas valve according to the estimated flue clogging value to control a supply amount of gas which is being introduced.

The controller may be provided with a data storage section in which data is stored, and the data storage section may include a first database and a second database stored therein. Here, the first database may include a target rotational speed, a target pneumatic pressure of the air blower, and a target opening amount of the gas valve for generating a target heat value, and the second database may include the target heat value, a rotational speed difference which is a difference between the rotational speed and the rotational speed measurement value of the air blower, a pneumatic pressure difference which is a difference between the target pneumatic pressure of the air blower and a pneumatic pressure measurement value of air which is introduced by rotation of the air blower, and the estimated flue clogging value according to the target heat value, the rotational speed difference, and the pneumatic pressure difference.

The data storage section may further include a third database that may be stored in the data storage section and may include the estimated flue clogging value and the opening amount of the gas valve according to the estimated flue clogging value.

The controller may include a data calculating section configured to linearly calculate and output the estimated flue clogging value and the opening amount of the gas valve using interpolation in which at least two pieces of data which are preset or calculated in advance are represented as a linear equation.

According to the boiler and the combustion control method of the boiler according to the present invention, it is possible to determine the clogging degree of the exhaust flue through which combustion gas is discharged in real time to adjust the gas supply amount and to maintain combustibility of the boiler.

In addition, by using the pneumatic pressure difference, which is a difference between a pressure of air introduced through the air blower and the target pneumatic pressure, and the rotational speed difference, which is a difference between the measurement value of the rotational speed of the air blower and the target rotational speed, it is possible to calculate the estimated flue clogging value, and thus to calculate the opening amount of the gas valve, thereby maintaining a gas ratio inside the combustion chamber and maintaining the combustibility of the boiler.

Furthermore, by providing the rotational speed difference, the pneumatic pressure difference, the estimated fluid clogging value and the opening amount of the gas valve according to the target heat value as a data table, it is possible to provide appropriate guidance which copes with a fluid clogging situation.

Also, the calculation section, which calculates and outputs the rotational speed difference, the pneumatic pressure difference, the estimated flue clogging value, and the opening amount of the gas valve according to the target heat value on the basis of the data table, may be provided to provide the linear output value and more precisely control combustion conditions of the boiler.

In addition, the boiler is configured to be able to cope with the flue clogging situation by using inexpensive equipment, and thus it is possible to increase the efficiency of the boiler.

BRIEF DESCRIPTION OF THE DRAWINGS

The above and other objects, features, and advantages of the present invention will become more apparent to those of ordinary skill in the art by describing exemplary embodiments thereof in detail with reference to the accompanying drawings, in which:

FIG. 1 is a structural view showing a schematic structure of a boiler according to the present invention;

FIG. 2 is a flowchart showing a combustion control method of the boiler according to the present invention;

FIG. 3 is a table showing one embodiment of a second database according to the present invention;

FIG. 4 is a table showing another embodiment of the second database according to the present invention;

FIG. 5 is a table showing that an estimated flue clogging value is calculated by applying the second database according to the present invention and by using interpolation;

FIG. 6 is a table showing that the estimated flue clogging value is calculated by applying the second database according to the present invention and by using interpolation;

FIG. 7 is a table showing that the estimated flue clogging value is calculated by applying the second database according to the present invention and by using interpolation;

FIG. 8 is a table showing one embodiment of a third database according to the present invention; and FIG. 9 is a table showing that an opening amount of a gas valve is calculated by applying a third database according to the present invention and by using interpolation.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

Hereinafter, a combustion control method of a boiler according to the present invention will be described in detail with reference to the accompanying drawings.

Here, the content described in the related art and the overlapping contents will be omitted, and the following description will be made based on components newly added to the present invention.

Referring to FIG. 1, a boiler 100 according to the present invention includes an air blower 110 configured to be rotated such that air and gas are introduced, a gas valve 120 configured to adjust an opening or closing degree of a gas supply pipe (not shown) into which gas is introduced, a burner (not shown) configured to combust gas, a flue (not shown) configured to discharge combustion gas, and a controller 200 configured to control the air blower 110 and the gas valve 120 to adjust amounts of air and gas supplied to the burner.

In addition, the boiler may be provided with a target temperature input section 160 for inputting a target temperature of heating or hot water to be provided by operation of the boiler.

The target temperature input section 160 is connected to the controller 200 to transmit a target heat value T, which is required for allowing the boiler 100 to achieve the target temperature, to the controller 200.

In addition, the boiler may further include a rotational speed measuring section 140 for measuring a rotational speed (RPM) of the air blower 110 and a pneumatic pressure measuring section 150 for measuring a pneumatic pressure of the air blower, which is a pressure of air introduced through the air blower 110.

The rotational speed measuring section 140 may include a rotation sensor for detecting the rotation number of the air blower 110 or a rotation sensor for detecting a rotation of a driving motor driving the air blower 110, and the rotational speed measuring section is connected to the controller 200 to transmit the measured rotational speed measurement value (RPM) to the controller 200.

In addition, the pneumatic pressure measuring section 150 may include a wind pressure sensor provided in a flow passage through which air introduced by the air blower 110 flows to the burner, and the pneumatic pressure measuring section 150 is connected to the controller 200 to transmit the pneumatic pressure measurement value to the controller 200.

The target heat value T, the rotational speed measurement value (RPM), and the pneumatic pressure measurement value are received by a receiving section 210 provided in the controller 200.

The controller 200 further includes a data storage section 220, in which a manual for controlling the boiler 100 is stored in a database form, a data calculating section 230 for performing preset calculation based on the database and information received by the receiving section 210, and an output section 240 for outputting a control command calculated through the data storage section 220 and the data calculating section 230.

The output section 240 is connected to an air blower adjusting section 300, which controls operation and rotational speed of the air blower 110, and a gas valve adjusting section 400 for controlling opening or closing and an opening amount of the gas valve 120, and thus the output section transmits a control command to these sections.

A target rotational speed (RPM), a target pneumatic pressure of the air blower, and target opening amount of the gas valve for generating the target heat value T may be stored in the data storage section 220 as a first database.

In addition, an estimated flue clogging value B based on the target heat value T, a rotational speed difference V which is a difference between the target rotational speed (RPM) and the rotational speed measurement value RPM, and a pneumatic pressure difference P which is a difference between the target pneumatic pressure of the air blower and the pneumatic pressure measurement value may be stored in the data storage section 220 as a second database.

In this case, the rotational speed difference V and the pneumatic pressure difference P may be calculated in the data calculating section 220 and then input to the data storage section 220.

In addition, an opening amount X of the gas valve according to the estimated flue clogging value B may be stored in the data storage section 220 as a third database.

The first database, the second database, and the third database may be configured through an experiment in a manufacturing process of the boiler 100 and then stored in the data storage section 220.

In this case, since the first database, the second database, and the third database are non-linearly configured, the data calculating section 230 is configured to calculate the estimated flue clogging value B and the opening amount X of the gas valve using the first database, the second database, and the third database when there is no stored data, and so it is possible to provide a linear output value.

The estimated flue clogging value B and the opening amount X of the gas valve may be calculated using interpolation and, in particular, may be calculated using first-order interpolation in which two preset databases are represented by a linear equation.

The combustion method of the boiler according to the present invention will be described with reference to FIG. 2.

A step S10 is a step in which combustion of the boiler 100 is controlled by applying the first database.

An operation command is input to the boiler 100, and the target temperature T is input through the target temperature input section 160 and then received by the controller 200. In addition, the target rotational speed (RPM), the target pneumatic pressure of the air blower, and the target opening amount of the air valve are calculated in the first database of the data storage section 220 according to the target heat value T, and a control command is then transmitted to the air blower adjusting section 300 and the gas valve adjusting section 400 through the output section 240 to control the air blower 110 and the gas valve 120.

Accordingly, the air blower 110 is controlled to be rotated at the target rotational speed (RPM), and the gas valve 120 is controlled to be opened at the target opening amount of the gas valve.

A step S20 is a step in which the rotational speed measurement value (RPM) and the pneumatic pressure measurement value are measured in the rotational speed measuring section 140 and the pneumatic pressure measuring section 150.

The rotational speed measuring section 140 and the pneumatic pressure measuring section 150 may be configured to measure the rotational speed measurement value (RPM) and the pneumatic pressure measurement value in real time or at a preset time intervals and transmit the measurements to the controller 200.

A step S30 is a step of calculating the estimated flue clogging value B by applying the second database.

The data calculating section 230 compares the rotational speed measurement value (RPM) and the pneumatic pressure measurement value with the target rotational speed (RPM) and the target pneumatic pressure of the air blower to calculate the rotational speed difference V and the pneumatic pressure difference P and applies the second database of the data storage section 220 to calculate the estimated flue clogging value B estimated by the rotational speed difference V and the pneumatic pressure difference P according to the target heat value T.

The estimated flue clogging value B may be a value representing a degree of clogging of the flue as a percentage.

The step S30 will be described in detail with reference to one embodiment of the second database as follows.

Referring to FIGS. 3 and 4, the second database includes a table (see FIG. 3) for the case where the target heat value T is 100% of the maximum heat value which is the maximum limit of the heat value which may be generated from the boiler and a table (see FIG. 4) for the case where the target heat value is 80% of the maximum heat value which is the maximum limit of the heat value which may be generated from the boiler. Here, in each case, the estimated flue clogging value B (an intersection of a horizontal value and a vertical value) according to the rotational speed difference V (a horizontal axis) and the pneumatic pressure difference P (a vertical axis) is shown.

As one example, in the case where the target heat value T is 90%, the target rotational speed (RPM) is 2176 revolutions per minute, and the target pneumatic pressure is 70 hPa, whereas the rotational speed measurement value (RPM) is 2800 revolutions per minute and the pneumatic pressure measurement value is 86 hPa, which are measured in the step S20, a method for calculating the estimated flue clogging value B (the intersection of the horizontal value and the vertical value) is described below.

First, the rotational speed difference V and the pneumatic pressure difference P are calculated as follows.

Rotational speed difference $V$=Rotational speed-measurement value (RPM)−Target rotational speed (RPM)=2800−2176=624

Pneumatic pressure difference $P$=Pneumatic pressure measurement value−Target pneumatic pressure=86−70=16

Thereafter, the estimated flue clogging value B is calculated using interpolation with reference to FIGS. 5 to 7.

FIG. 5 is a table in which the calculated value of 624 of the rotational speed difference V is arbitrarily added between 583 and 895 of the horizontal axis V (rotational speed difference) of FIG. 3 and the calculated pneumatic pressure difference P of 16 is arbitrarily added between 15 and 36 of the vertical axis P (pneumatic pressure difference). With reference to this table, in a case where the target heat value T is 100%, it is possible to calculate the estimated flue clogging value B1 when the rotational speed difference V is 583 and the pneumatic pressure difference P is 16, calculate the estimated flue clogging value B2 when the rotational speed difference V is 624 and the pneumatic pressure difference P is 16, and calculate the estimated flue clogging value B3 when the rotational speed difference V is 895 and the pneumatic pressure difference P is 16 using interpolation as follows.

$$B1 = \{(16-15)*(90-80)/(36-15)\} + 80 = 80.48$$

$$B3 = \{(16-15)*(90-80)/(36-15)\} + 80 = 80.48$$

$$\begin{aligned} B2 &= \{(B3-B1)(624-583)/(895-580)\} + B1 \\ &= \{(80.48-80.48)(624-583)/(895-580)\} + 80.48 \\ &= 80.48 \approx 80 \text{ (Rounding off)} \end{aligned}$$

Accordingly, it can be calculated that the estimated flue clogging value B2 is about 80% when the target heat value T is 100%, the rotational speed difference V is 624, and the pneumatic pressure difference P is 16.

FIG. 6 is a table in which the calculated value of 624 of the rotational speed difference V is arbitrarily added between 600 and 1120 of the horizontal axis V (rotational speed difference) of FIG. 4 and the calculated value of 16 of pneumatic pressure difference P is arbitrarily added between 0 and 18 of the vertical axis P (pneumatic pressure difference). Referring to this table, in a case where the target heat value T is 100%, it is possible to calculate the estimated flue clogging value B4 when the rotational speed difference V is 600 and the pneumatic pressure difference P is 16, calculate the estimated flue clogging value B5 when the rotational speed difference V is 624 and the pneumatic pressure difference P is 16, and calculate the estimated flue clogging value B6 when the rotational speed difference V is 1120 and the pneumatic pressure difference P is 16 using interpolation as follows.

$$B4 = \{(16-0)*(90-70)/(18-0)\} + 70 = 87.78$$

$$B6 = \{(16-0)*(90-80)/(18-0)\} + 80 = 88.89$$

$$\begin{aligned} B5 &= \{(B6-B4)(624-600)/(1120-600)\} + B4 \\ &= \{(88.89-87.78)(624-600)/(1120-600)\} + 87.78 \\ &= 87.83 \approx 88 \text{ (Rounding off)} \end{aligned}$$

Accordingly, it can be calculated that the estimated flue clogging value B5 is about 88% when the target heat value T is 80%, the rotational speed difference V is 624, and the pneumatic pressure difference P is 16.

Then, as shown in FIG. 7, by referring to the estimated flue clogging value B2 when the target heat value T is 100% and the estimated flue clogging value B5 when the target heat value T is 80%, the estimated flue clogging value B when the target heat value T is 90%, the rotational speed difference V is 624, and the pneumatic pressure difference P is 16 is calculated using interpolation.

$$\begin{aligned} B &= \{(B2-B5)(90-80)/(100-80)\} + B5 \\ &= \{(80-88)(90-80)/(100-80)\} + 88 = 84 \end{aligned}$$

Accordingly, it can be calculated that the estimated flue clogging value B is about 84% when the target heat value T is 90%, the rotational speed difference V is 624, and the pneumatic pressure difference P is 16.

A step S40 is a step of calculating the opening amount X of the gas valve by applying the third database.

The data calculating section 230 applies the third database of the data storage section 220 to calculate the opening amount X of the gas valve based on the estimated flue clogging value B.

The step S30 will be described in more detail with reference to one embodiment of the third database as follows.

Referring to FIG. 8, the third database may be comprised of a table regarding the opening amount X of the gas valve according to the estimated flue clogging value B.

Accordingly, by arbitrarily adding the estimated flue clogging value B of 84% between the flue clogging values of 80% and 90% of FIG. 8 (see FIG. 9), the opening amount X of the gas valve when the estimated flue clogging value B is 84% may be calculated using interpolation as follows.

$$\begin{aligned} X &= \{(B-80)(9-7)/(100-80)\} + 7 \\ &= \{(84-80)(9-7)/(100-80)\} + 7 = 8 \end{aligned}$$

Accordingly, the opening amount X of the gas valve is calculated as 8 when the target heat value T is 90%, the rotational speed difference V is 624, the pneumatic pressure difference P is 16, and the estimated flue clogging value B is 84%.

A step S50 is a step of transmitting the opening amount X of the gas valve from the gas valve adjusting section 400 to adjust an opening degree of the gas valve 120.

According to the boiler and the combustion control method of the boiler according to the present invention, it is possible to determine the clogging degree of the exhaust flue through which combustion gas is discharged in real time to adjust the gas supply amount and to maintain combustibility in the boiler.

In addition, by using the pneumatic pressure difference P, which is a difference between a pressure of air introduced through the air blower 110 and the target pneumatic pressure, and the rotational speed difference V, which is a difference between the measurement value (RPM) of the rotational speed of the air blower and the target rotational speed, it is possible to calculate the estimated flue clogging value, and thus to calculate the opening amount X of the gas valve, thereby maintaining a gas ratio inside the combustion chamber and maintaining the combustibility of the boiler.

Furthermore, the rotational speed difference V, the pneumatic pressure difference P, the estimated flue clogging value B, and the opening amount X of the gas valve according to the target heat value T may be provided as the data table to provide appropriate guidance so as to cope with a flue clogging situation.

Also, the calculation section, which calculates and outputs the rotational speed difference V, the pneumatic pressure difference P, the estimated flue clogging value B, and the opening amount X of the gas valve according to the target heat value T on the basis of the data table, may be provided to provide the linear output value and more precisely control combustion conditions of the boiler.

The present invention is not limited to the above-described embodiments, obvious modifications can be made by those skilled in the art to which the present invention pertains without departing from the technical spirit of the present invention as claimed in the claims, and these modifications are within the scope of the present invention.

What is claimed is:

1. A combustion control method of a boiler provided with an air blower configured to rotate such that air and gas are introduced, a gas valve configured to adjust an opening or closing degree of a gas supply pipe into which gas is introduced, and a controller configured to control the air blower and the gas valve, the method comprising the steps of:

A) calculating an estimated flue clogging value for estimating the degree of flue clogging by comparing a preset target rotation speed of the air blower according to the target heat value with the rotation speed measurement value of the air blower, and simultaneously comparing a preset target air pressure which is the pressure of the air introduced by the rotation of the air blower according to the target heat value with the air pressure measurement value which is the pressure of the air introduced by the rotation of the air blower; and B) controlling an opening degree of the gas valve with the amount of the gas valve according to the calculated estimated flue clogging value to control a supply amount of gas which is being introduced, thereby adjusting gas ratio inside a combustion chamber and maintaining the combustibility of the boiler.

2. The method of claim 1, wherein the step A) comprises the steps of;

a) inputting a target temperature of heat or hot water provided by operation of the boiler and setting a target heat value for achieving the target temperature;

b) calculating a target rotational speed of the air blower, a target pneumatic pressure which is the pressure of the air introduced by rotation of the air blower, and a target opening amount of the gas valve according to the target heat value and applying the target rotational speed, the target pneumatic pressure, and the target opening amount to control the air blower and the gas valve;

c) measuring the rotational speed of the air blower and the pneumatic pressure of the air introduced by rotation of the air blower in real time; and d) calculating a rotational speed difference which is a difference between the target rotational speed and a rotational speed measurement value, calculating a pneumatic pressure difference which is a difference between the target pneumatic pressure and a pneumatic pressure measurement value, and calculating the estimated flue clogging value according to the target heat value, the rotational speed difference, and the pneumatic pressure difference.

3. The method of claim 2, wherein, in the step b), the controller is configured to calculate the target rotational speed and the target pneumatic pressure according to the target heat value by substituting the target heat value into a first database in which data of the target rotational speed, the target pneumatic pressure, and the opening amount of the gas valve are stored.

4. The method of claim 2, wherein in the step d), the controller is configured to calculate the opening amount of the gas valve according to the estimated flue clogging value by substituting the estimated flue clogging value into a third database in which data of the opening amount of the gas valve is stored.

5. The method of claim 2, wherein the estimated flue clogging value and the opening amount of the gas valve are linearly calculated and output using interpolation in which at least two pieces of data which are preset or calculated in advance are represented as a linear equation.

6. A boiler comprising:

a rotational speed measuring section configured to measure a rotational speed of an air blower by which gas and air are introduced;

a pneumatic pressure measuring section configured to measure a pneumatic pressure which is a pressure of air introduced through the air blower; and a controller configured to calculate an estimated flue clogging value for estimating the degree of flue clogging by comparing a preset target rotation speed of the air blower according to the target heat value with the rotation speed measurement value of the air blower, and simultaneously comparing a preset target air pressure which is the pressure of the air introduced by the rotation of the air blower according to the target heat value with the air pressure measurement value which is the pressure of the air introduced by the rotation of the air blower and to adjust an opening degree of the gas valve with the amount of a gas valve according to the calculated estimated flue clogging value to control a supply amount of gas which is being introduced, thereby adjusting gas ratio inside a combustion chamber and maintaining the combustibility of the boiler.

7. The boiler of claim 6, wherein the controller is provided with a data storage section in which data is stored, wherein the data storage section comprises:

a first database comprising a target rotational speed, a target pneumatic pressure of the air blower, and a target opening amount of the gas valve for generating a target heat value; and a second database comprising the target heat value, a rotational speed difference which is a difference between the rotational speed and the rotational speed measurement value of the air blower, a pneumatic pressure difference which is a difference between the target pneumatic pressure of the air blower and a pneumatic pressure measurement value of air which is introduced by rotation of the air blower, and the estimated flue clogging value according to the target heat value, the rotational speed difference, and the pneumatic pressure difference.

8. The boiler of claim 7, wherein the data storage section further comprises a third database that is stored in the storage section and comprises the estimated flue clogging value and the opening amount of the gas valve according to the estimated flue clogging value.

9. The boiler of claim 6, wherein the controller comprises a data calculating section configured to linearly calculate and output the estimated flue clogging value and the opening amount of the gas valve using interpolation in which at least two pieces of data which are preset or calculated in advance are represented as a linear equation.

* * * * *